US007823505B2

(12) United States Patent
Paita

(10) Patent No.: US 7,823,505 B2
(45) Date of Patent: Nov. 2, 2010

(54) MACHINE AND METHOD FOR MARKING HOLLOW PARTS

(75) Inventor: Marco Paita, Oyonnax (FR)

(73) Assignee: Cer, Oyonnax (FR)

( * ) Notice: Subject to any disclaimer, the term of this patent is extended or adjusted under 35 U.S.C. 154(b) by 749 days.

(21) Appl. No.: 11/708,063

(22) Filed: Feb. 20, 2007

(65) Prior Publication Data

US 2007/0199455 A1 Aug. 30, 2007

(30) Foreign Application Priority Data

Feb. 21, 2006 (FR) ..... 06 01506

(51) Int. Cl.
*B41F 17/08* (2006.01)

(52) U.S. Cl. ..... 101/38.1; 101/39; 101/123

(58) Field of Classification Search ..... 101/35–37, 101/38.1, 39, 40, 40.1, 116, 123, 124
See application file for complete search history.

(56) References Cited

U.S. PATENT DOCUMENTS 3,283,739 A * 11/1966 Hinterkopf ..... 118/676
6,840,166 B2 * 1/2005 Jeter et al. ..... 101/38.1
7,261,033 B2 * 8/2007 Dubuit et al. ..... 101/40.1
2001/0042456 A1 * 11/2001 Kamen et al. ..... 101/38.1
2003/0121428 A1 * 7/2003 Kamen et al. ..... 101/38.1

FOREIGN PATENT DOCUMENTS

EP 0 999 047 5/2000
FR 2 633 062 12/1989
FR 2881976 A1 * 8/2006

* cited by examiner

*Primary Examiner*—Ren Yan
(74) *Attorney, Agent, or Firm*—Dowell & Dowell, P.C.

(57) ABSTRACT

This machine for marking hollow parts comprises a marking member designed to be on contact in at least one line of tangency with a hollow part for it to be marked, and a first and a second mandrel capable of supporting respectively a first part to be marked and a second part previously marked. A control camera is placed at a focal length from the marked surface of the second part. The first mandrel is capable of moving the first part relative to the marking member and the movement of the second mandrel is slaved and identical to that of the first mandrel. The camera is capable of moving parallel to, and in synchronism with, the line of tangency between the marking member and the first part.

7 Claims, 3 Drawing Sheets

MACHINE AND METHOD FOR MARKING HOLLOW PARTS

BACKGROUND OF THE INVENTION

1. Field of the Invention

The present invention relates to a machine for marking hollow parts and a method for marking hollow parts and for controlling the quality of their marking.

Within the meaning of the invention, a hollow part is a part that is at least partly tubular with a noncircular cross section.

2. Description of the Related Art

To mark hollow parts, it is a known practice to use a marking machine comprising a marking member, such as a flat stamp or a screen-printing doctor blade, and at least one mandrel for supporting the parts for them to be marked by this marking member. Furthermore, FR-A-2 633 062 discloses, in the case of parts with a circular cross section, the practice of integrating into a marking machine a device for controlling the quality of the marking of the parts. More specifically, this document divulges a screen-printing marking machine comprising two distinct stations, designed respectively for marking and quality control. In these two stations, the part to be marked or to be controlled is rotated about its central axis. The marking is made by moving a print screen relative to the surface of the part to be marked. The quality of the marking is controlled by moving a camera relative to the marked surface of the part to be controlled, so that the camera reads each marking line of the part. In the case of parts of circular cross section, the movement to be communicated to the camera is relatively simple. However, this movement rapidly becomes complex in the case of parts whose marked surface has variations of curvature radius.

It is this disadvantage that the invention aims more particularly to remedy by proposing a machine for marking hollow parts making it possible to effectively control the quality of the marking of the parts, with the aid of a camera whose movement relative to the marked surface of the parts is simple, irrespective of the profile of the parts.

SUMMARY OF THE INVENTION

Accordingly, the subject of the invention is a machine for marking hollow parts, comprising a marking member designed to be in contact on at least one line of tangency with a hollow part for it to be marked, and first and second mandrels capable of supporting respectively a first part to be marked and a second part previously marked on the first mandrel by the marking member, a control camera being placed at a focal length from the marked surface of the second part, wherein the first mandrel is capable of moving the first part relative to the marking member in rotation about an axis and in translation parallel to two axes perpendicular to one another and to the axis of rotation, the movement of the second mandrel being slaved and identical to that of the first mandrel and the camera being capable of moving parallel to, and in synchronism with, the line of tangency between the marking member and the first part.

According to other advantageous features of the invention:

- the tangential speed of the first part relative to the marking member is substantially constant;
- the frequency of the camera shots depends on the tangential speed of the first part relative to the marking member;
- the first and second mandrels are mounted on one and the same support that moves them parallel to the aforementioned axes of translation;

- the marking machine comprises means for rotationally synchronizing the first and second mandrels;
- the marking machine comprises a manipulator for transferring parts between the first and second mandrels, the support being movable between a second position in which the manipulator is capable of unloading a part from the first mandrel and a first position in which the manipulator is capable of loading the part onto the second mandrel;
- the marking member is a flat stamp or a screen-printing doctor blade.

A further object of the invention is a method for marking a hollow part and for controlling the quality of its marking, wherein it comprises steps in which:

- a marking member marks the part, the part being moved relative to the marking member, by a first mandrel, in rotation about an axis and in translation parallel to two axes perpendicular to one another and to the axis of rotation;
- a camera controls the quality of the marking of the part by moving at a focal length from the marked surface of the part, the part being moved by a second mandrel whose movement is identical to that of the first mandrel.

Such a method may comprise steps in which:

- when the part is marked by the marking member, a support, to which the first and second mandrels are connected, moves parallel to the two axes of translation from a first position to a second position;
- the part is unloaded from the first mandrel by a manipulator for transferring the part between the first and second mandrels, this manipulator being capable of unloading the part from the first mandrel in the second position of the support and of loading the part onto the second mandrel in the first position of the support;
- the support moves from the second position to the first position;
- the manipulator loads the part onto the second mandrel;
- the camera controls the quality of the marking of the part supported by the second mandrel.

In addition, each picture taken by the camera is advantageously corrected to take account of relative vibrations of the second mandrel and the camera.

BRIEF DESCRIPTION OF THE DRAWINGS

The features and advantages of the invention will appear in the following description of an embodiment of a machine for marking hollow parts according to the invention, given only as an example and made with reference to the appended drawings in which.

DESCRIPTION OF THE PREFERRED EMBODIMENTS

Figure 1:
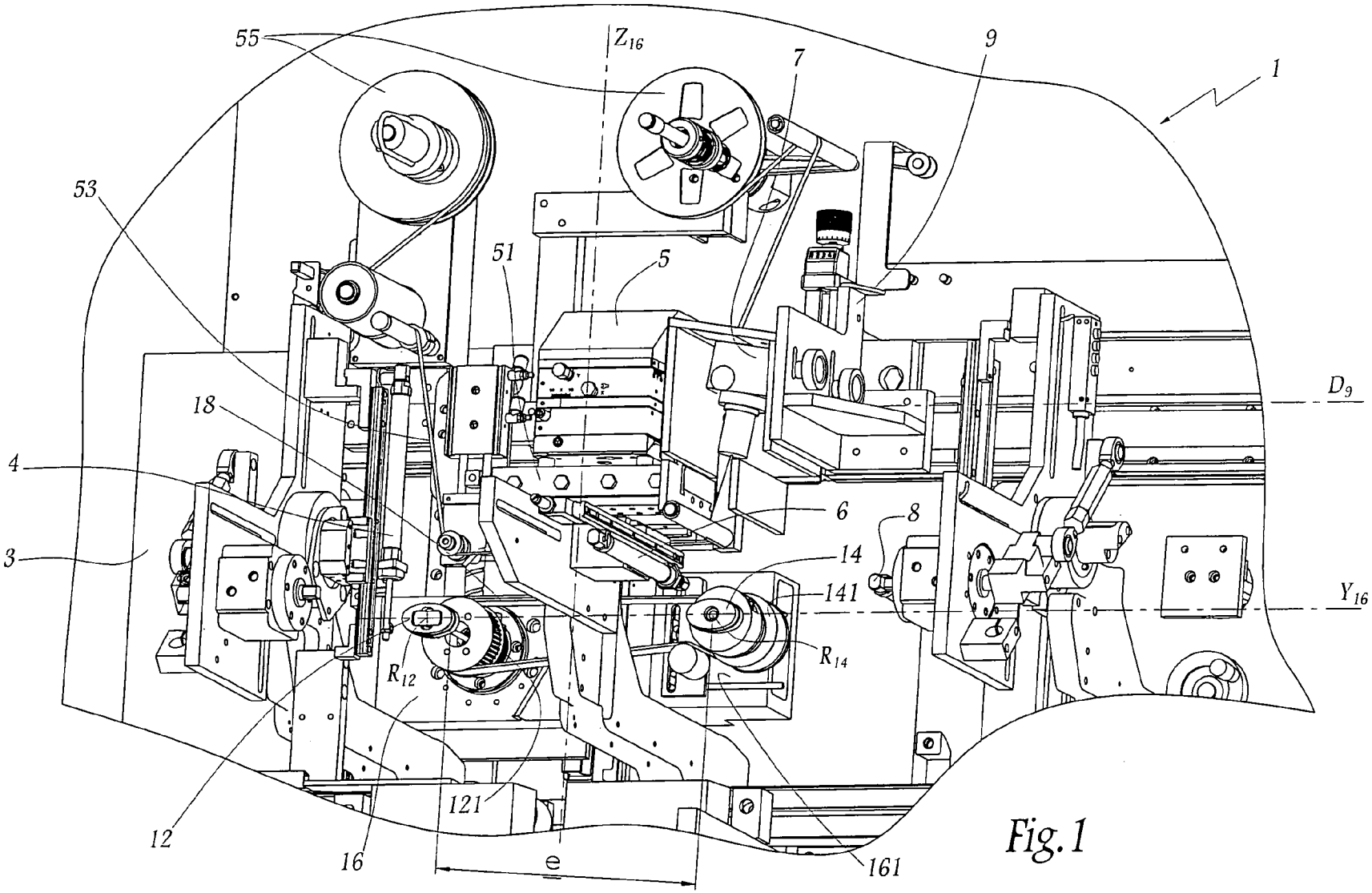
FIG. 1 is a view in perspective of a machine for marking hollow parts according to the invention, prior to the marking and quality control.

FIG. 1 shows a machine 1 for marking hollow parts, that are oval caps 2 not shown in FIG. 1 for better visibility. In this description, the terms "upstream" and "downstream" refer to the direction of travel of the parts 2 on the machine 1. The marking machine 1 comprises a main frame 3 that supports a marking head 5 provided with a fixed flat stamp 51. A marking ribbon 53 is provided to be unrolled opposite the stamp 51, by means of two reels 55. The machine 1 also comprises two mandrels 12 and 14 for supporting the parts 2. The upstream mandrel 12 is designed to receive a part 2, for it to be marked by the marking head 5, while the downstream mandrel 14 is designed to receive a marked part 2, for the purpose of controlling the quality of its marking.

The two mandrels 12 and 14 are mounted so as to pivot on one and the same support 16 that can move relative to the frame 3 parallel to two perpendicular axes of translation $Y_{16}$ and $Z_{16}$, respectively horizontal and vertical. The support 16 is moved relative to the frame 3 by means of an actuator of known type not shown in the figures. Each of the mandrels 12 or 14 has a pivoting axis $R_{12}$ or $R_{14}$ oriented perpendicularly to the plane defined by the axes $Y_{16}$ and $Z_{16}$.

The upstream mandrel 12 is rotated about the axis $R_{12}$ by a drive shaft 121. Therefore, the upstream mandrel 12, associated with the marking head 5, is capable of moving the part 2 that it supports relative to the fixed stamp 51 for it to be marked. More specifically, the part 2 is capable of rolling substantially without sliding beneath the stamp 51 and of moving relative to the stamp 51 in the direction of the axes $Y_{16}$ and $Z_{16}$. The tangential speed of the part 2 to be marked relative to the stamp 51 is substantially constant during the marking. It may however be modulated according to the local curvature radius of the part 2 to be marked.

The downstream mandrel 14 is supported in rotation by a shaft 141 connected to the drive shaft 121 of the upstream mandrel 12 by a transmission belt 18. Thus, the rotation of the downstream mandrel 14 about the axis $R_{14}$ is slaved to that of the upstream mandrel 12 about the axis $R_{12}$. The mandrels 12 and 14 both being supported by and fixedly attached in translation to the support 16, the movement of the downstream mandrel 14 is therefore identical to that of the upstream mandrel 12.

The marking machine 1 comprises three manipulators 4, 6 and 8 fixed to the frame 3 and designed for the loading and unloading of the mandrels 12 and 14. The upstream manipulator 4 is intended to load onto the upstream mandrel 12 a part 2 to be marked, while the downstream manipulator 8 is intended to unload from the downstream mandrel 14 a marked part 2 whose marking has been controlled. In the example shown, the manipulators 4 and 8 are of the type described in FR-A-2 853 274.

Figure 2:
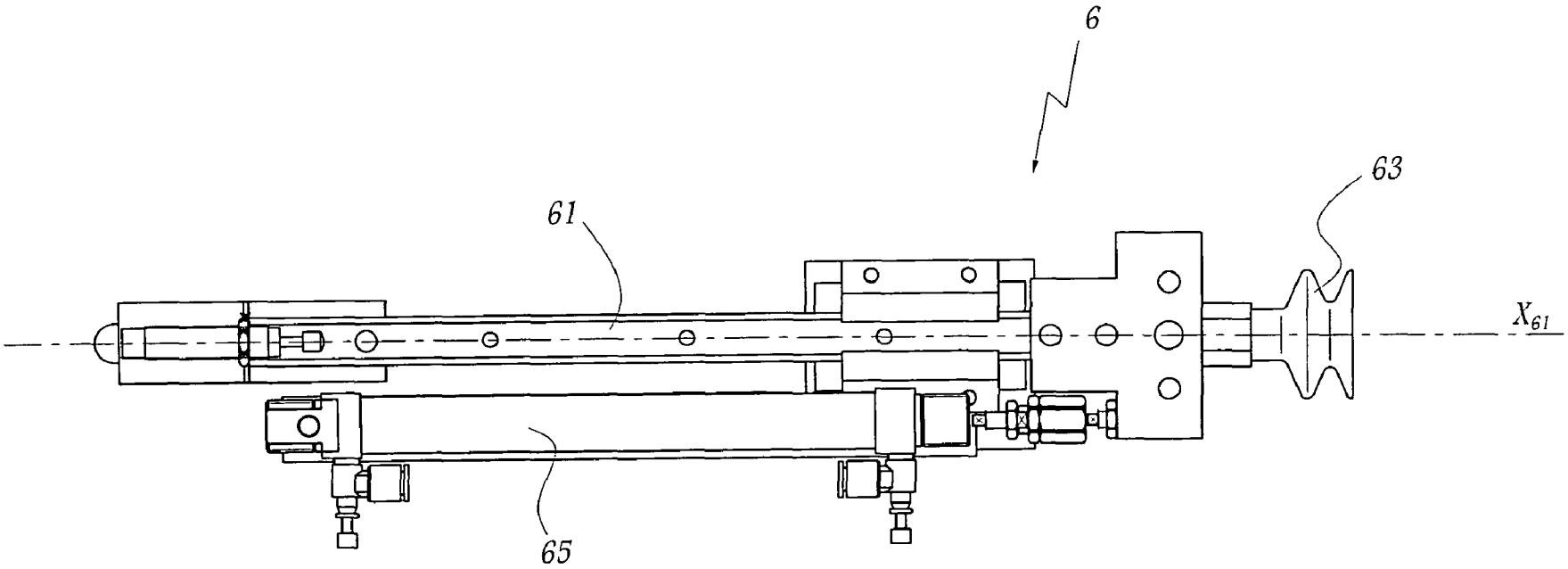
FIG. 2 is a view in perspective of a transfer manipulator belonging to the machine of FIG. 1.

The intermediate manipulator 6 is designed for the transfer of a part 2, that has been marked on the upstream mandrel 12, to the downstream mandrel 14, for the purpose of controlling the quality of its marking. This transfer manipulator 6 is known per se. As can be seen in FIG. 2, it comprises a retractable arm 61 that is mounted so as to slide relative to the frame 3 and one of whose ends is provided with a suction cup 63 for gripping the parts 2. The manipulator 6 also comprises a cylinder 65, capable of sliding the arm 61 in its longitudinal direction $X_{61}$ which, in the example shown, is substantially horizontal and perpendicular to the plane defined by the axes $Y_{16}$ and $Z_{16}$.

The manipulator 6 transfers each part 2, once marked, from the upstream mandrel 12 to the downstream mandrel 14. After having picked up a part 2 marked on the upstream mandrel 12, then having removed it from this mandrel 12, the manipulator 6 waits until the downstream mandrel 14 has been placed in the axis of this part 2, by translation of the support 16 relative to the frame 3. When this is the case, the manipulator 6 moves this part 2 to the downstream mandrel 14 and releases it when it is slipped onto this mandrel 14. The manipulator 6 then moves to a waiting position, away from the trajectories of the mandrels 12 and 14. When it is transferred between the mandrels 12 and 14, each part 2 is thus translated along its central axis, in one direction and then in the opposite direction.

In FIGS. 3 to 7, the vertical axis $Z_6$ shows the position of the manipulator 6.

The distance between the upstream manipulator 4 and the transfer manipulator 6, on the one hand, and the distance between the transfer manipulator 6 and the downstream manipulator 8, on the other hand, are adjustable. In particular, in the example shown, the distance between each pair of manipulators is chosen to be equal to the center-to-center distance e between the mandrels 12 and 14.

The marking machine 1 is also provided with a linear camera 7 designed to control the quality of the marking of a marked part 2, supported by the downstream mandrel 14. The camera 7 may be of the type marketed by the company DALSA under the reference 2048-pixel SPYDER 2. It may also be of another type, particularly of the type specified in FR-A-2 633 062. This camera 7 is supported by a carriage 9 mounted so as to slide relative to the frame 3 in a direction $D_9$ parallel to the axis $Y_{16}$. The carriage 9 is designed to move the camera 7 so that its reading line coincides constantly, during the quality control of the marking of a part 2 supported by the downstream mandrel 14, with the marked surface of this part 2.

Figure 3:
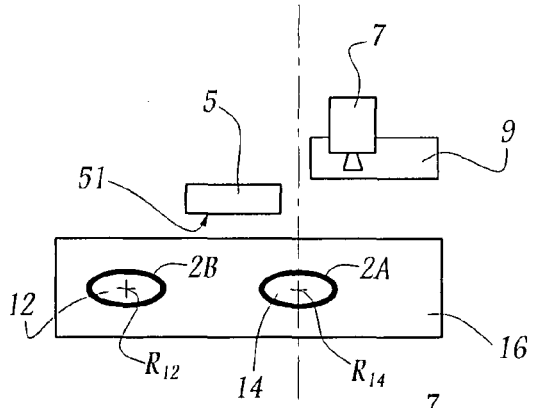
FIGS. 3 to 7 are schematic partial front views of certain elements of the machine of FIG. 1 showing successive steps of a method for marking hollow parts and for controlling the quality of their marking according to the invention.
Figure 4:
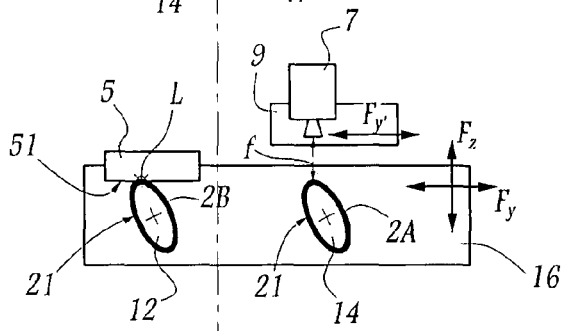
Figure 5:
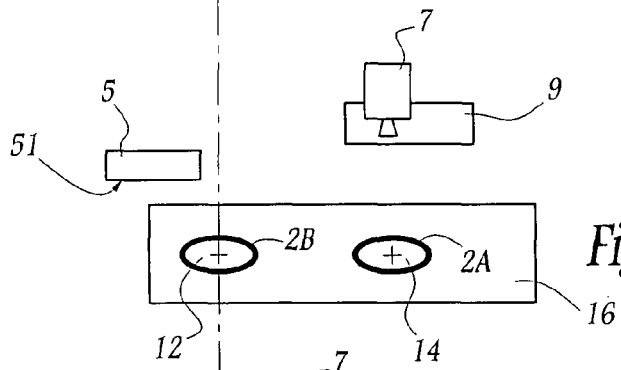

More precisely and with reference to FIGS. 3 to 5, the camera 7 is placed at a distance corresponding to its focal length f relative to the outer surface 21 of a part 2A supported by the downstream mandrel 14, the part 2A having previously been marked on the upstream mandrel 12 by the stamp 51. When the part 2A is moved by the downstream mandrel 14 slaved to the upstream mandrel 12, the camera 7 is moved by the carriage 9 parallel to, and in synchronism with, the line L of tangency between the stamp 51 and the outer surface 21 of a part 2B being marked on the upstream mandrel 12. This line of tangency is perpendicular to the plane of FIG. 4 and shown in this figure by a dot corresponding to its intersection with the plane of this figure.

The movement of the marked part 2A in rotation about the axis $R_{14}$ and in translation parallel to the axes $Y_{16}$ and $Z_{16}$ makes it possible to obtain a movement of the line L only in the direction of the axis $Y_{16}$. Therefore, the marking machine 1 according to the invention makes it possible to control the quality of the marking of the parts 2 with a simple movement of the camera 7, this movement being limited to a translation parallel to the axis $Y_{16}$. Such is also the case for more complex hollow parts, such as for example parts with a polygonal cross section.

The movement of the camera 7 and the frequency of shots are defined by a coder, not shown. The frequency of the shots of the camera 7 is constantly adapted to the speed of travel of the marked surface 21 of the marked part 2A, this speed being equal to the tangential speed relative to the stamp 51 of the part 2B being marked on the upstream mandrel 12. In particular, the frequency of shots increases when the tangential speed of the part 2B relative to the stamp 51 increases.

In order to limit the relative vibrations of the downstream mandrel 14 and of the camera 7 in directions parallel to the axis $R_{14}$, the support 16 comprises a reinforcing bracket 161 in the vicinity of the mandrel 14. The residual vibrations of the mandrel 14 during its movement are recorded and subtracted from the pictures taken by the camera 7, in order to obtain corrected pictures. Similarly, account can be taken of the vibrations of the camera 7 on its carriage 9.

The marking machine 1 comprises an electronic command and control unit, not shown, that controls its operation. In particular, this unit controls the manipulators 4, 6 and 8 and the means for maneuvering the mandrel 12, the support 16 and the carriage 9, based on information originating from sensors, also not shown for the purposes of clarity.

A method for marking a hollow part 2B and for controlling the quality of its marking by means of the marking machine 1 comprises steps as described below, with reference to FIGS. 3 to 7:

First of all, the upstream manipulator 4 and the transfer manipulator 6 place respectively, and substantially simultaneously, a part 2B to be marked on the upstream mandrel 12 and a part 2A, previously marked, on the downstream mandrel 14. The support 16 is then in a first position, that can be seen in FIG. 3, in which the upstream mandrel 12 is positioned upstream of and beneath the stamp 51, in the vicinity of the upstream end of the stamp 51.

The upstream mandrel 12 is then moved in translation by the support 16 parallel to the axes $Y_{16}$ and $Z_{16}$ and in rotation about the axis $R_{12}$ so as to move the part 2B relative to the stamp 51 for it to be marked, as can be seen in FIG. 4. The part 2B is marked by rolling relative to the stamp 51, which corresponds to a movement of the support 16 from its first position, visible in FIG. 3, to a second position, visible in FIG. 5. During this marking, the stamp 51 presses on the surface 21 of the part 2B along the line of tangency L.

At the same time as the marking of the part 2B supported by the upstream mandrel 12, the part 2A, supported by the downstream mandrel 14 and previously marked on the upstream mandrel 12, is moved by the downstream mandrel 14 relative to the camera 7 for its marking to be quality controlled. The movement of the downstream mandrel 14 is slaved to that of the upstream mandrel 12, in translation thanks to the support 16 that simultaneously moves the two mandrels in the plane of the axes $Y_{16}$ and $Z_{16}$, and in rotation thanks to the belt 18 that drives the mandrel 14 in rotation about the axis $R_{14}$ simultaneously with the rotation of the mandrel 12 about the axis $R_{12}$. The marking of the part 2A is quality controlled by moving the camera 7 parallel to, and in synchronism with, the line of tangency L, thanks to the carriage 9. The movements of the support 16 are shown by the double arrows $F_y$ and $F_z$ in FIG. 4, while the corresponding and simultaneous movements of the carriage 9 of the camera 7 are shown by the arrow $F'_y$. Thus, since the movement of the downstream mandrel 14 is identical to that of the upstream mandrel 12, the camera 7 is kept at a focal length f from the marked surface of the part 2A during the control, as can be seen in FIG. 4. In addition, each picture taken by the camera 7 is corrected to take account of any relative vibrations of the downstream mandrel 14 and the camera 7, which ensures the reliability and accuracy of the quality control of the marking of the part 2A supported by the mandrel 14.

When the marking of the part 2B supported by the upstream mandrel 12 and the simultaneous quality control of the marking of the part 2A have taken place, the support 16 is in its second position, visible in FIG. 5. In this position of the support 16, the transfer manipulator 6 and downstream manipulator 8 are capable of unloading respectively, and substantially simultaneously, the mandrels 12 and 14. More precisely, the downstream manipulator 8 transfers the part 2A, whose marking has been controlled as being satisfactory by means of the camera 7, from the downstream mandrel 14 to a receptacle or a conveyor for carrying away the marked parts, not shown in the figures. Simultaneously, the transfer manipulator 6 picks up the part 2B and removes it from the upstream mandrel 12.

Figure 6:
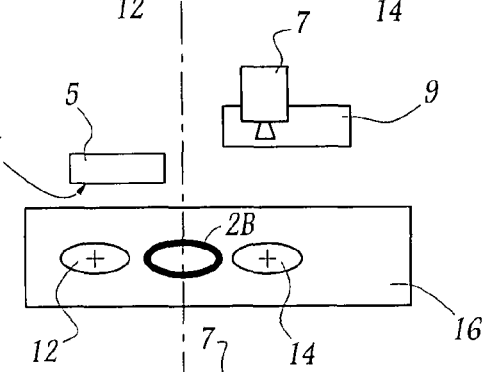

The support 16 is then brought back from its second position to its first position. In this step, and as can be seen in FIG. 6, the mandrels 12 and 14 are supporting no part and the part 2B is supported by the transfer manipulator 6.

Figure 7:
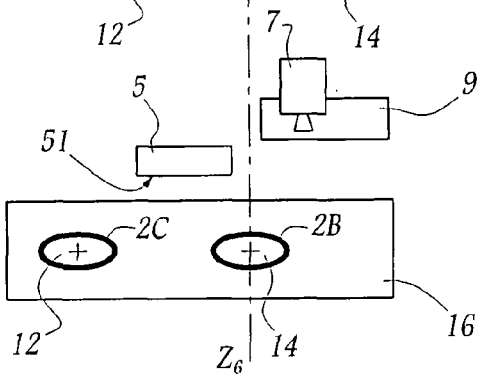

When the support 16 has returned to its first position visible in FIG. 7, the upstream manipulator 4 and the transfer manipulator 6 place respectively, and substantially simultaneously, a part 2C to be marked on the upstream mandrel 12 and the marked part 2B on the downstream mandrel 14. The quality control of the marking of the part 2B then takes place at the same time as the marking of the part 2C, by repetition of the steps of FIGS. 3 to 6, the part 2A being replaced by the part 2B and the part 2B by the part 2C.

The marking machine 1 according to the invention therefore makes it possible both to mark hollow parts 2 and control the quality of their marking. The relative movement of the camera 7 and of the controlled part 2, supported by the downstream mandrel 14, makes it possible to keep the camera 7 at a focal length f from the marked surface of the part 2 during the control and thus ensure a reliable control of the marking. Taking account of the relative vibrations of the mandrel 14 and the camera 7 to correct the pictures taken by the camera 7 contributes to the accuracy of the quality control. In addition, the slaving of the movement of the downstream mandrel 14 to that of the upstream mandrel 12, by means of the support 16 and the belt 18, makes it possible to obtain a compact machine for marking and marking quality control, particularly more compact and economical than two juxtaposed machines of which one would be dedicated to marking and the other to controlling the quality of the marking. Finally, the movement of the camera 7 for controlling the marked surface of the parts 2 takes place in a single direction, thanks to the movement of the marked part 2 by the mandrel 14 both in rotation and in translation in two directions.

According to a variant of the invention not shown, the flat stamp 51 may be replaced by a screen-printing doctor blade associated with a print screen. In this case, the upstream mandrel 12 moves a hollow part 2 to be marked beneath the screen texture in a similar manner to the case of the flat stamp, the line of tangency between the screen-printing doctor blade and the part 2 to be marked then corresponding to a line of the screen-printing doctor blade oriented parallel to the axis of rotation $R_{12}$ of the part 2 to be marked. The quality control of the marking of a marked part 2 supported by the downstream mandrel 14, whose movement is slaved to that of the upstream mandrel 12, takes place, as in the case of the flat stamp, by movement of the camera 7 parallel to, and in synchronism with, the line of tangency between the screen-printing doctor blade and the part being marked. The movement of the camera 7 is therefore in this case a movement of translation along an axis parallel to the axis $Y_{16}$ of FIG. 1. Advantageously, the screen-printing doctor blade and the camera 7 are moved by one and the same carriage in translation parallel to the axis $Y_{16}$.

The invention claimed is:

1. A machine for marking hollow parts, comprising a marking member which contacts a hollow part along at least one line of tangency with the hollow part during a marking operation, first and second mandrels capable of supporting respectively a first part to be marked and a second part previously marked on the first mandrel by the marking member, a control camera placed at a focal length from a marked surface on the second part, wherein the first mandrel is capable of moving the first part relative to the marking member in rotation about an axis and in translation parallel to two axes perpendicular to one another and to the axis of rotation, the movement of the second mandrel being slaved and identical to that of the first mandrel, and the camera being capable of moving parallel to, and in synchronism with, the line of tangency between the marking member and the first part.

2. The marking machine as claimed in claim 1, wherein a tangential speed of the first part relative to the marking member is substantially constant.

3. The marking machine as claimed in claim 1, wherein a frequency of camera shots depends on a tangential speed of the first part relative to the marking member.

4. The marking machine as claimed in claim 1, wherein the first and second mandrels are mounted on a common support that moves them parallel to said axes of translation.

5. The marking machine as claimed in claim 4, including a manipulator for transferring parts between the first and second mandrels, the common support being movable between a second position in which the manipulator is capable of unloading a part from the first mandrel and a first position in which the manipulator is capable of loading said part onto the second mandrel.

6. The marking machine as claimed in claim 1, including means for rotationally synchronizing the first and second mandrels.

7. The marking machine as claimed in claim 1, wherein the marking member is a flat stamp or a screen-printing doctor blade.

* * * * *